US005609474A

United States Patent [19]

Ohno

[11] Patent Number: 5,609,474

[45] Date of Patent: Mar. 11, 1997

[54] GEAR PUMP

[75] Inventor: Tohru Ohno, Kanagawa, Japan

[73] Assignee: Tokyo Buhin Kogyo Co., Ltd., Yamato, Japan

[21] Appl. No.: 220,715

[22] Filed: Mar. 31, 1994

[30] Foreign Application Priority Data

Sep. 30, 1993 [JP] Japan ..... 5-58375 U
Oct. 18, 1993 [JP] Japan ..... 5-61139 U

[51] Int. Cl.[6] ..... F04B 49/035

[52] U.S. Cl. ..... 417/288; 417/310; 417/428; 418/196

[58] Field of Search ..... 417/251, 310, 417/288, 426, 428; 418/196

[56] References Cited

U.S. PATENT DOCUMENTS

| | | | |
|---|---|---|---|
| 2,382,701 | 8/1945 | Egersdorfer | 418/196 |
| 2,933,158 | 4/1960 | Pitts | 417/310 |
| 3,168,043 | 2/1965 | Wiggermann | 417/310 |
| 3,182,596 | 5/1965 | Prijatel | 417/310 |
| 3,232,234 | 2/1966 | Butterworth | 417/310 |
| 3,824,041 | 7/1974 | Rystom | 417/310 |
| 3,873,241 | 3/1975 | Motomura | 417/310 |
| 4,165,206 | 8/1979 | Martin et al. | 418/196 |
| 4,204,811 | 5/1980 | Carter et al. | 417/428 |
| 4,502,845 | 3/1985 | Chana | 417/428 |
| 4,838,767 | 6/1989 | Ohe et al. | 417/310 |
| 4,850,813 | 7/1989 | Fisher | 417/288 |
| 5,087,177 | 2/1992 | Haley et al. | 417/426 |

FOREIGN PATENT DOCUMENTS

| | | | |
|---|---|---|---|
| 594340 | 11/1947 | United Kingdom | 417/310 |

*Primary Examiner*—John J. Vrablik
*Assistant Examiner*—William Wicker
*Attorney, Agent, or Firm*—Flynn, Thiel, Boutell & Tanis, P.C.

[57] ABSTRACT

A gear pump having three gears, including; a pump case consisting of a pump body and a cover for covering most of the body; three gears which are supported by a rotating shaft on the pump case and engaged with each other in series; first and second gear pumps each composed of one central drive gear and one of the driven gears on both sides of the drive gear; a non-return valve and a flow regulation valve which are opened at a predetermined pressure; an inlet port which is opened at one end of the pump case and connected through a feed path to the suction side of the two gear pumps; an outlet port formed on the discharge side of the first gear pump in the pump case; a regulation path passing from the discharge side of the second gear pump through the non-return valve to the outlet port; and a flow regulation path passing from the regulation path through the flow regulation valve to an oil pan.

4 Claims, 9 Drawing Sheets

GEAR PUMP

BACKGROUND OF THE INVENTION

1. Technical Field of the Invention

The present invention relates to a gear pump used to lubricate an engine (an internal combustion engine), and particularly to a gear pump capable of reducing the engine load at a high RPM rate of the engine.

2. Prior Art

A gear pump driven by an engine capable of reducing engine load at high RPM (revolutions per minute) rates of the engine is disclosed in Examined Japanese Utility Model Publication 5-33739. As shown in FIG. 14, this gear pump for lubricating an engine comprises: a first pump formed of a driving gear 1; a first driven gear 2 externally contacting and engaging with said driving gear 1; a casing including a second pump formed of a second driven gear 3 externally contacting and engaging with the driving gear 1; an outlet circuit 6 connected to an outlet port 5 of the second gear pump which is formed of the driving gear 1 and the second driven gear. 3 and included in the casing; and an outlet circuit 7 which is connected to a port 4 of the first pump formed of the driving gear 1 and the first driven gear 2, and connected through a non-return valve 8 to the outlet circuit 6. The prior art pump also has: a bypass circuit 9 which is branched from the outlet circuit 6 between the outlet port 4 and the non-return valve 8 and is connected to an oil pan; a flow regulation valve 10 which is provided in said bypass circuit 9, fully closed at a lower limit lubricatable pressure to fully close the bypass circuit 9, and opened at an increased pressure of a lubricant to open the bypass circuit 9; and a pressure communicating circuit 12 which communicates from an outlet circuit 11 connected to the outlet circuit 7 connecting the outlet circuit 6 to the flow regulation valve 10. There is also a temperature sensing valve 13 which is provided in said pressure communicating circuit 12 that fully closes the pressure communicating circuit 12 at an appropriate temperature of the lubricant, and that opens the pressure communicating circuit 12 at an increased temperature of the lubricant.

With the above-mentioned assembly, the gear pump operates as described below. The second gear pump formed of the driving gear 1 and the second driven gear 3 is operated at a revolution speed in proportion to the revolution speed of an engine, and supplies the lubricant through the outlet circuit 6 and the outlet circuit 11 to places requiring the lubrication of the engine at all times. When the temperature and pressure of the lubricant is low, the first gear pump formed of the driving gear 1 and the first driven gear 2 supplies all the discharged lubricant, which passes from the port 4 through the outlet circuit 7 and pushes up the non-return valve 8 to join the outlet circuit 6, through the outlet circuit 11 to places requiring the lubrication of the engine in a manner similar to the above.

When the lubricant temperature increases, the temperature sensing valve 13 operates to cause the pressure communicating circuit 12 to be opened. Consequently, the lubricant in the outlet circuit 11 acts on the valve disk of the flow regulation valve 10. In this case, when the lubricant pressure is within the lower lubricant limit pressure, the valve disk does not operate. This means that the bypass circuit 9 is fully closed to cause all the discharged oil to be supplied to the engine. When the lubricant pressure exceeds the lower lubricant limit pressure, part of the discharged oil is returned through the bypass circuit 9 to the oil pan. When the lubricant pressure is high, the flow regulation valve 10 is fully opened to cause the bypass circuit 9 to be fully opened.

This causes the lubricant in the outlet circuit 7 to be bypassed. Consequently, the lubricant pressure is reduced to an extent that the pressure becomes lower than the lubricant pressure in the outlet circuit 6. Therefore, the non-return valve 8 does not operate to cause all the discharged oil of the first pump to be bypassed.

In this way, in Examined Japanese Utility Model Publication 5-33739, the discharge rate of the first pump is regulated by both the lubricant temperature and the lubricant pressure at all times, so that a lubricant exceeding a lubricant pressure and a lubricant temperature required at respective times is continuously bypassed. Therefore, no extra work is performed, thereby reducing an engine load.

However, the gear pump as shown in the above-mentioned Examined Japanese Utility Model Publication 5-33739, there are problems as shown below:

(1) The above-mentioned outlet ports 4, 5, outlet circuits 6, 7, 11, bypass circuit 9 and the like together with inlet ports and inlet circuits are formed in the casing, and the above-mentioned non-return valve 8 and flow regulation valve 10 are housed in the casing, which causes the composition of the gear pump to become very complex, the degree of freedom in design and manufacture to become narrow, and the manufacturing cost to be increased.

(2) Even if a ball valve is used for the above-mentioned non-return valve, a guide cylinder having an opening or a slit is provided in a manner to surround the ball valve in order to make smooth the engaging with and disengaging from the valve seat, where the guide cylinder is disposed in a space in which a passage is changed perpendicularly from the vertical to horizontal direction, the ball valve is pushed against the horizontal passage side due to the flow of oil and the like, so that a larger opening causes the ball valve to be bound to the opening and thus to be prevented from a smooth operation.

The fine slit also causes the fluid resistance to become large.

(3) The valve piston of the above-mentioned flow regulation valve opens/closes the output ports to have a large slide stroke, so that the lubrication on the outer periphery of the valve piston is poor so as to cause scuffing and valve malfunction.

OBJECT OF THE INVENTION

In view of the above-mentioned problems, it is an object of the present invention to provide a compact pump in which the above-mentioned outlet ports, outlet circuits, bypass circuit and the like together with the inlet ports and the inlet circuits can be formed in the pump case, and further the non-return valve and the flow regulation valve be housed in the pump case, without making the assembly unduly complex.

It is another object of the present invention to provide a gear pump in which smooth operation of the ball valve in the above-mentioned non-return valve can be established without increasing fluid resistance.

It is still another object of the present invention to provide a gear pump which allows the valve piston of the above-mentioned flow regulation valve to operate smoothly.

DETAILED DESCRIPTION OF THE INVENTION

With reference to drawings, a gear pump of the present invention will be explained in detail.

The numeral 1 indicates a pump case which comprises a pump body 2 and a cover 3 which is mounted by bolts or the like to the body 2 and has approximately the same thickness as the above-mentioned pump body 2.

Figure 11:
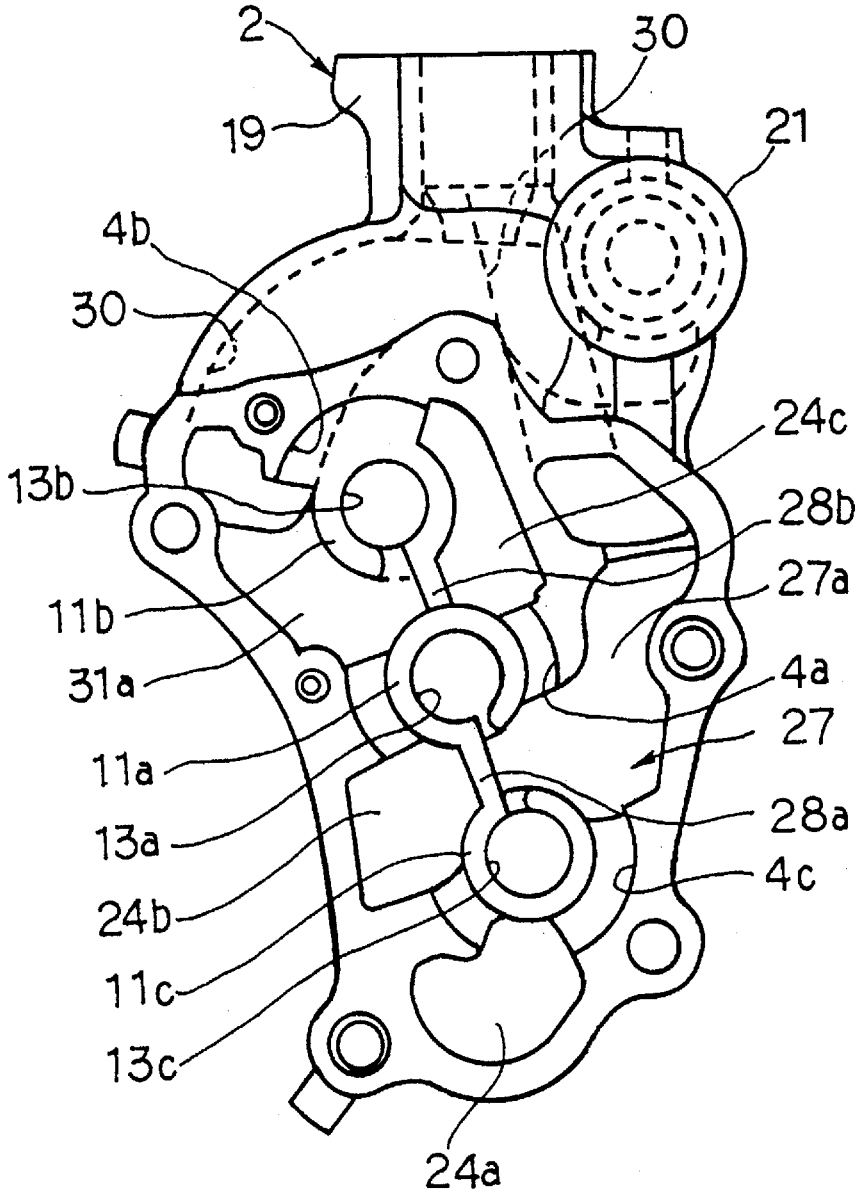
FIG. 11 is a plan view of a pump body.
Figure 12:
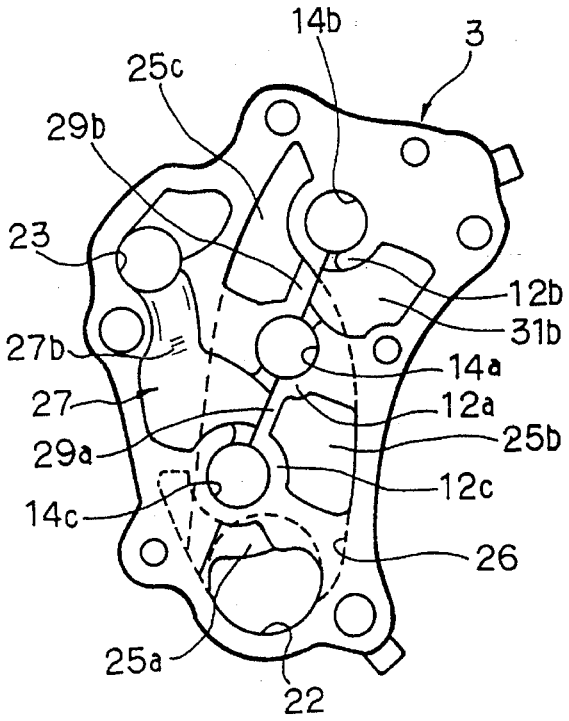
FIG. 12 is a plan view of a cover.
Figure 13:
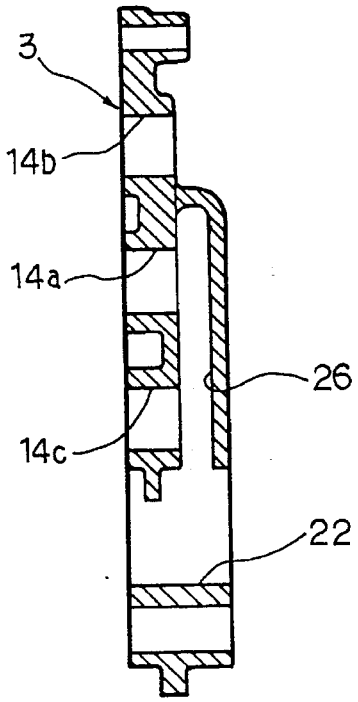
FIG. 13 is a side view of a cover.
Figure 14:
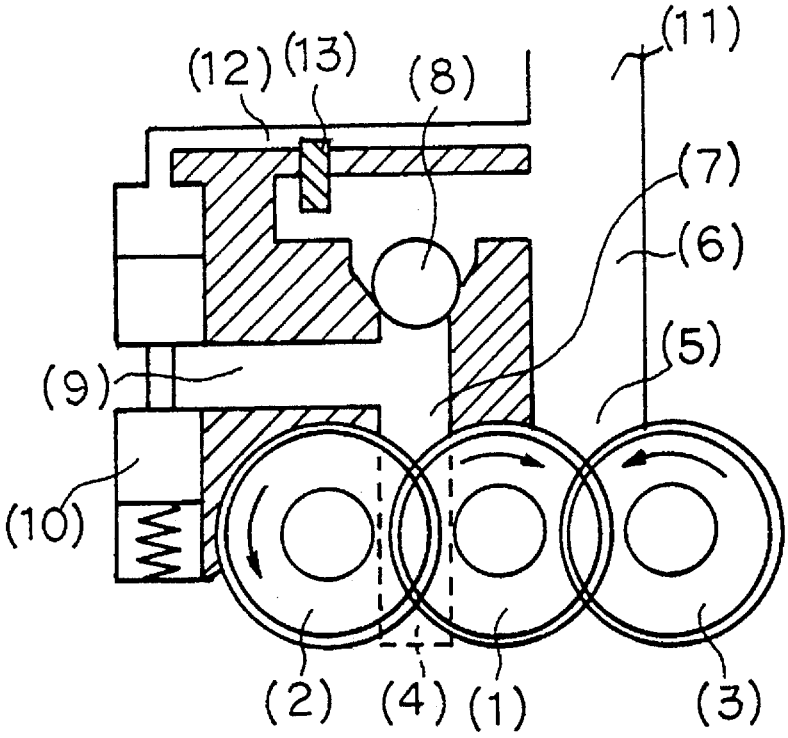
FIG. 14 PRIOR ART
FIG. 14 is a circuit view of a conventional gear pump.

In the above-mentioned pump body 2, there are formed gear housing spaces 4*a*, 4*b*, 4*c*, (FIG. 11). A driving gear 5 is located at the center space 4*a*. Two driven gears 6, 7 engaging with said gear 5 from the upper and lower sides and having the same diameter as the driving gear are somewhat diagonally disposed in series and are seated in spaces 4*b* and 4*c*, respectively. Shafts 8, 9, 10 of the above-mentioned gears 5, 6, 7 are supported in supporting holes 13*a*, 13*b*, 13*c* and 14*a*, 14*b*, 14*c* (FIG. 2) made in bosses 11*a*, 11*b*, 11*c* and 12*a*, 12*b*, 12*c* formed, respectively in the pump body 2 and cover 3. Bosses 11 are seen in FIG. 11, bosses 12 are seen in FIG. 12.

The engaging of the above-mentioned driving gear 5 with the driven gear 6 forms a first pump 15 while the engaging of the above-mentioned driving gear 5 with the driven gear 7 forms a second pump 16.

Figure 1:
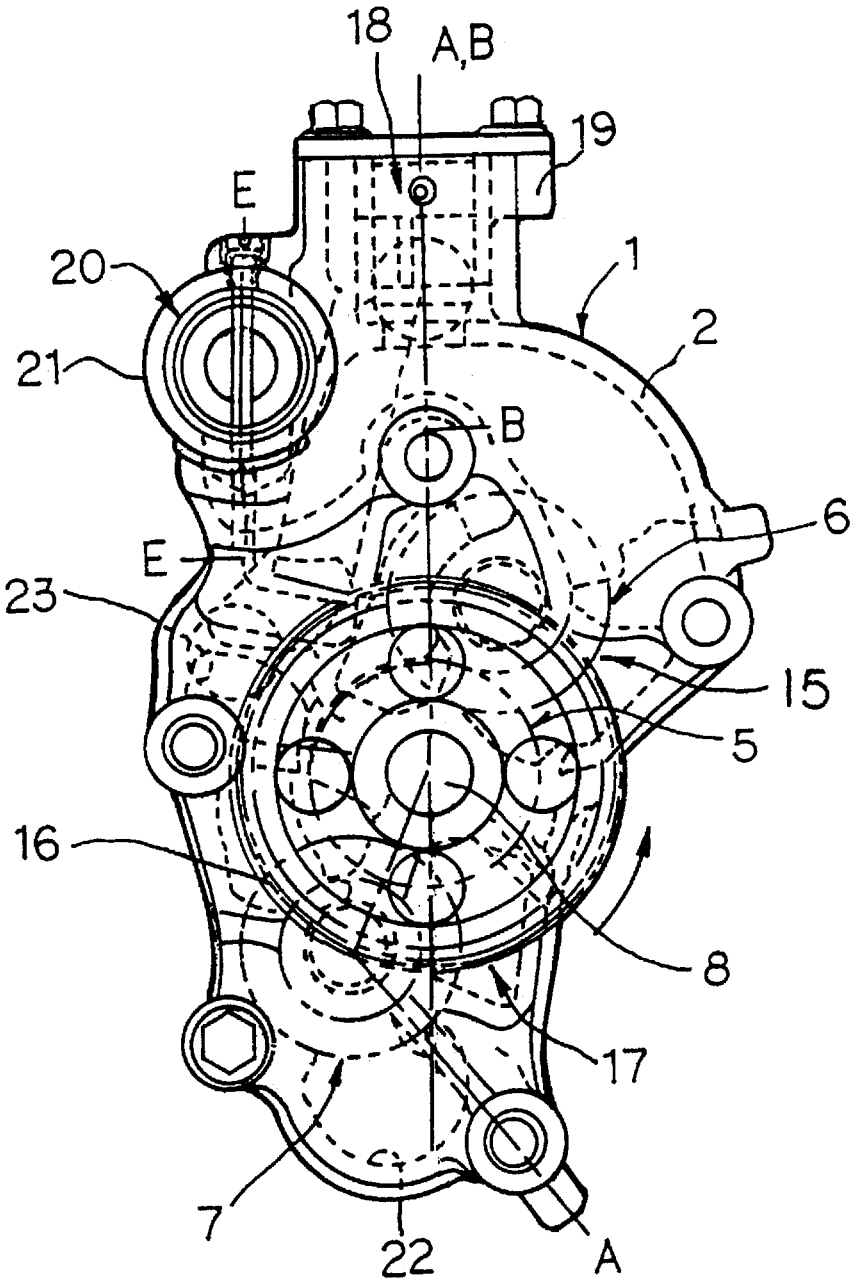
FIG. 1 is a front view of a gear pump of the present invention.
Figure 2:
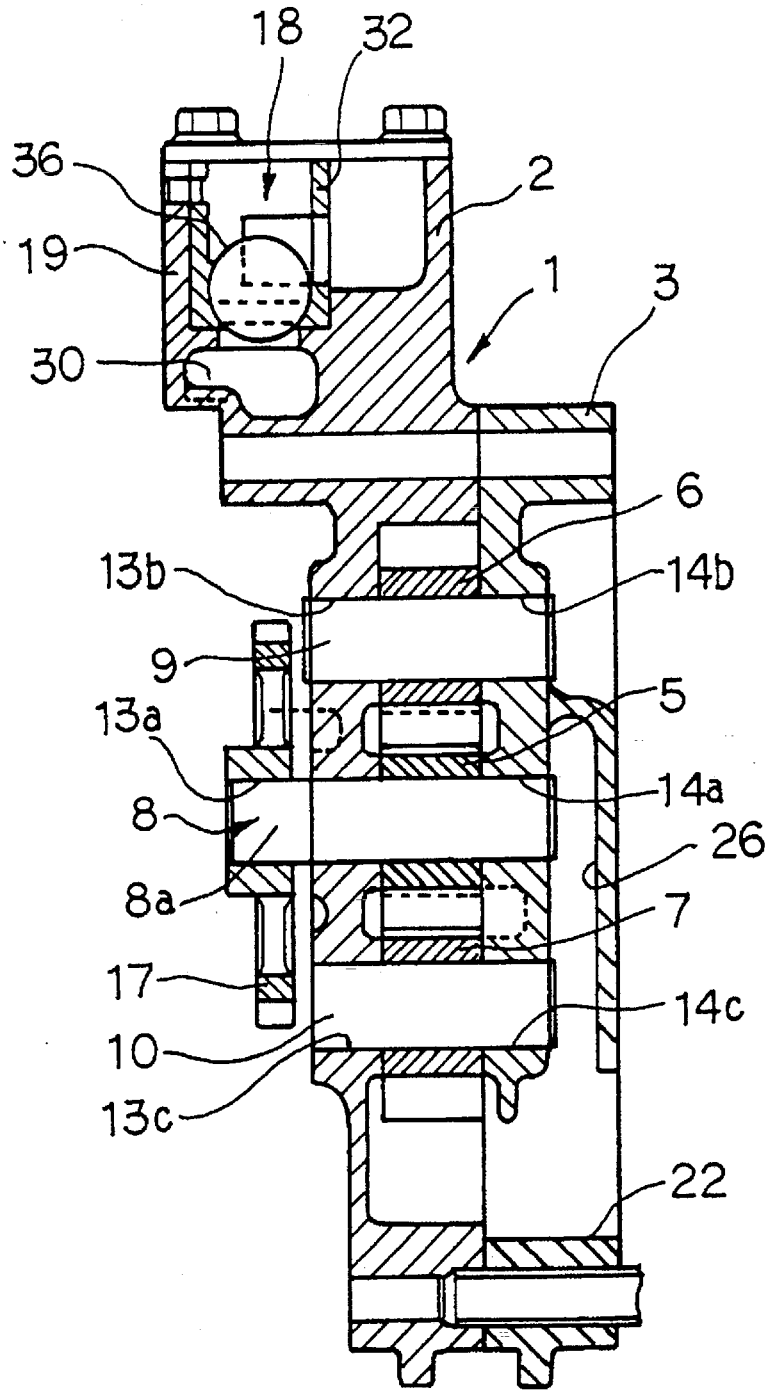
FIG. 2 is a sectional view taken on line A—A of FIG. 1.

The shaft 8 of the above-mentioned driving gear 5 is longer than the shafts 9, 10 of the driven gears 6 and 7, respectively. Shaft 8 protrudes beyond the pump body 2, thereby mounting fixedly a wheel 17 to a protruded portion 8*a* of the shaft (FIG. 2). Therefore, when the wheel 17 rotates counterclockwise as shown with an arrow in FIG. 1, the driven gears 6 and 7 that engage the driving gear 5 are rotated clockwise.

On the upper side of the above-mentioned pump body 2, there are formed integrally a case 19 of a one-way, non-return valve 18 described later and a case 21 of a flow regulation valve (relief valve) 20.

The numeral 22 indicates an inlet port for a lubricant and the like, which is formed in the above-mentioned cover 3 near the second gear pump 16 located on the lower side. The numeral 23 indicates an outlet port, which is formed also in the cover 3 near the first gear pump 15.

The numerals 24*a*, 24*b*, 24*c* (FIG. 11) indicate inlet liquid traps formed in the inlet sides of the small gear pumps 15, 16 of the pump body 2. Complementary inlet liquid traps are formed also on the cover 3 side at positions corresponding to the inlet liquid traps 24*a*, 24*b*, 24*c* on the above-mentioned pump body 2 side as indicated by the numerals 25*a*, 25*b*, 25*c*, FIG. 12. On the cover 3, there is formed a supply passage 26 which connects the above-mentioned inlet liquid traps 25*a*, 25*b*, 25*c* with the above-mentioned inlet port 22.

The numeral 27 indicates an outlet passage, a half portion 27*a* of which is formed at a position corresponding to that from the outlet side of the above-mentioned small gear pump 16 to the above-mentioned outlet port 23 across partition walls 28*a*, 28*b* between the above-mentioned liquid traps 24*b* and 24*c* in the pump body 2.

Another half portion 27*b* of the outlet passage 27, is formed in the cover 3 and is formed at the same position as the half portion 27*a* formed in the above-mentioned pump body 2, and at a position from the outlet side of the above-mentioned second pump 16 to the above-mentioned outlet port 23 across partition walls 29*a*, 29*b* located at the same position as the above-mentioned partition walls 28*a*, 28*b* between the above-mentioned liquid traps 25*b* and 25*c*.

The numeral 30 indicates a regulation passage, which is formed at a position corresponding to that from outlet liquid traps 31*a*, 31*b* of the pump body 2 and the cover 3 through inside the case 19 of the above-mentioned non-return valve 18 to the above-mentioned outlet port 23.

The above-mentioned non-return valve 18, which is shown in detail in FIGS. 3 through 6, is now described.

Figure 6:
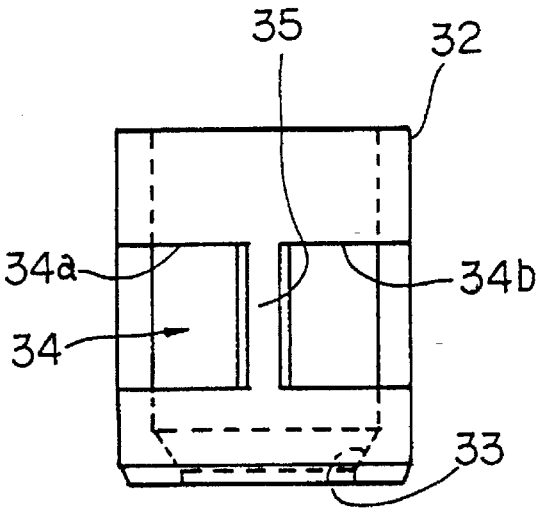
FIG. 6 is a front view of a valve controlling cage in a non-return valve.

In the drawings the numeral 32 indicates a cylindrical valve-controlling cage, as shown in FIG. 6, which is somewhat reduced in its lower internal diameter to form a valve seat 33 on which a ball valve, described later, is seated. The valve controlling cage 32 has an outlet port 34 for a control liquid such as lubricant on its intermediate portion side face, and provides a vertical guide 35 at the center of said outlet port 34 to form two outlet ports 34*a*, 34*b* having the same opening area. The upper end of the valve controlling cage 32 is opened.

The numeral 36 indicates a steel-made ball valve included in the valve-controlling cage 32, which is made somewhat smaller in diameter than the internal diameter of the above-mentioned valve controlling cage 32. The ball valve 36 formed precisely in a manner to be seated closely on the above-mentioned valve seat 33.

Figure 3:
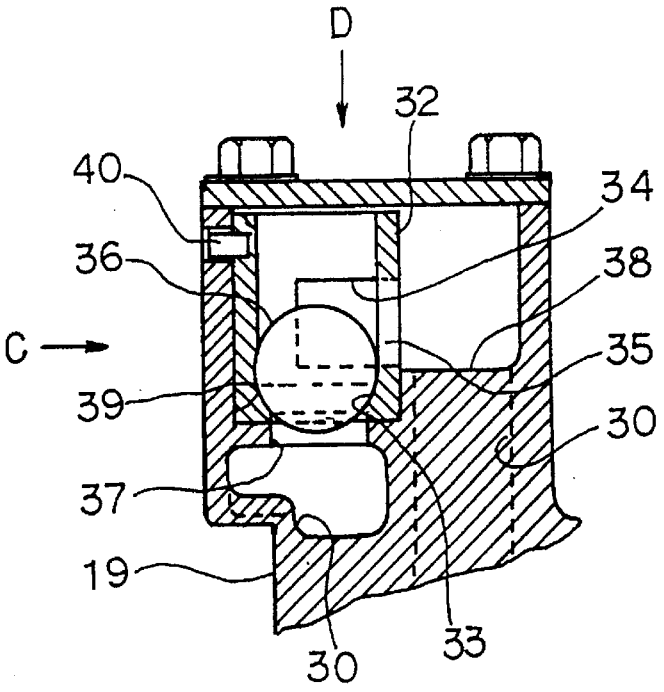
FIG. 3 is a sectional view taken on line B—B of FIG. 1.
Figure 4:
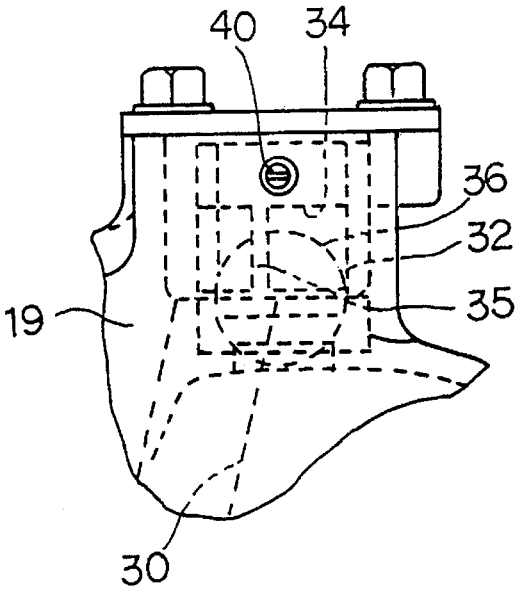
FIG. 4 is an equivalent arrow view in the C direction of FIG. 2.
Figure 5:
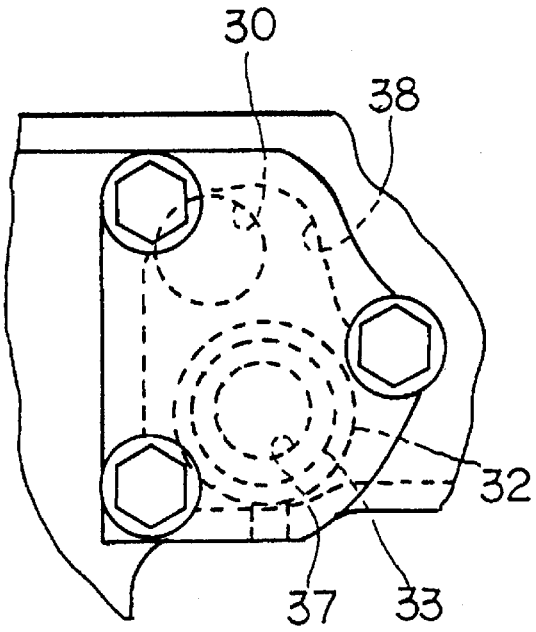
FIG. 5 is an equivalent arrow view in the D direction of FIG. 3.

The valve controlling cage 32, including the ball valve 36 as described above, is disposed in a space 39 extending perpendicularly from a vertical passage 37 communicating with the above-mentioned regulation passage 30 in the case 19 to a horizontal passage 38. The above-mentioned valve seat 33 faces downward and the above-mentioned outlet port 34 faces the horizontal passage 38. The valve controlling cage 32 is fixed by a machine screw 40 to the case 19, as shown in FIGS. 3 and 4, and in this point, is disposed in such a manner that the regulation passage 30 of a control liquid exists on an extended portion of the line connecting the center of the valve controlling cage 32 with the above-mentioned vertical guide 35 as shown in FIG. 5.

The above-mentioned flow regulation valve (relief valve) 20, which is shown in detail in FIGS. 7 through 10, is now described.

The flow regulation valve (relief valve) 20 has a valve piston 46 connecting a pressure receiving portion 43 through a connecting rod 45 to a sliding portion 44 and a spring receiver 47. The flow regulation valve (relief valve) 20 is installed in a valve bore 42 formed in a sleeve 41 fitted into the above-mentioned substantially cylindrical case 21. An inlet port 48 is connected to the above-mentioned regulation passage 30 is formed in the case 21 and the sleeve 41. An outlet port 49 formed in opposition to said inlet port 48. Inlet port 48 and outlet port 49 are opened and closed by the sliding portion 44 of the valve piston 46. A valve spring 50 is interposed between the above-mentioned valve piston 46 and a spring receiver 47. A hydraulic passage 51 is formed so that a pressure in the above-mentioned regulation passage 30 is caused to act on a head 43*a* of the pressure receiving portion 43 of the above-mentioned valve piston 46. The numeral 52 indicates a split pin for fixing the above-mentioned spring receiver 47; and the numeral 53, a plug.

In the flow regulation valve (relief valve) 20 of the present invention, the above-mentioned valve piston 46 has a plurality of oil grooves 54 formed on the outer periphery of the sliding portion 44 connected through the connecting rod 45 to the pressure receiving portion 43 thereof.

Figure 9:
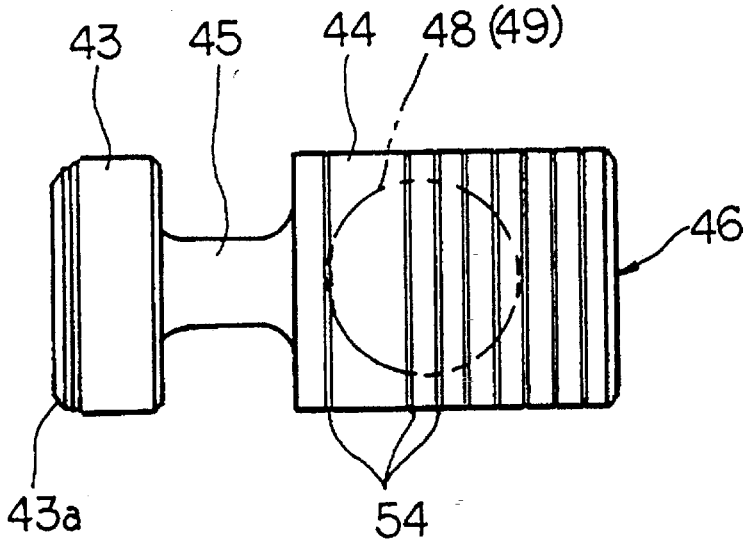
FIG. 9 is a front view of a piston valve.

Although the above-mentioned oil grooves 54 are formed on the outer periphery on which the sliding portion 44 of the above-mentioned valve piston 46 faces the above-mentioned inlet port 48 at least during non-operation of said piston, in the embodiment as shown in FIG. 9, total 8 grooves, one groove on the connecting rod 45 side of the sliding portion 44 and 7 grooves which are at appropriate intervals and somewhat apart from the side are formed, and 4 grooves, about half of the above-mentioned 7 grooves on the connecting rod 45 side, are placed on the half of the section of the above-mentioned inlet port 48 (and the outlet port 49).

Figure 10:
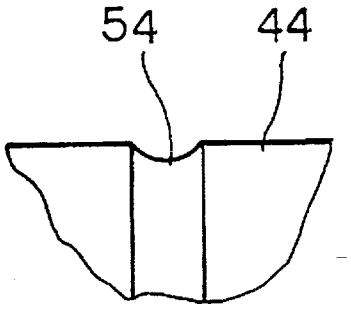
FIG. 10 is a partially enlarged view.

The shape of the above-mentioned oil grooves 54 is a circular fine groove with a shallow section as shown in FIG. 10, 0.7 to 1.0 mm wide, 0.4 to 0.7 mm deep and 3 to 4 mm in pitch.

Although after all, the shape, width, depth, pitch, the number of grooves, and the like of the above-mentioned oil grooves 54 are selected so as to make less the leakage before valve opening as described later and provide an amount of lubricant to such an extent as not to develop a scuffing in the sliding portion 44, they are eventually determined by an experiment and the like.

In the gear pump of the present invention composed as described above, the gear pump is mounted to an engine, and the inlet port 22 and the above-mentioned outlet port 23 are connected, respectively, to the oil pan and the lubricant circuit of the engine. The above-mentioned wheel 17 is caused to rotate counterclockwise (arrow) in FIG. 1 by the engine output, whereby the driving gear 5 is rotated and thus the driven gears 6, 7 are rotated by the driving gear 5. In this manner, in the above-mentioned second pump 16, the lubricant is discharged from the inlet port 22 through the inlet liquid traps 24*a*, 25*a* directly to, and through the above-mentioned supply passage 26 and the liquid traps 24*b*, 25*b* to the inlet and outlet passages 27, respectively, and then supplied from the outlet port 23 to places requiring the lubrication of the engine.

The first pump 15 acts during the low rotation region of the engine in a similar manner to the above-mentioned second pump 16. That is, the lubricant is sucked from the inlet port 22 through the supply passage 26 and then flows into the inlet liquid traps 24*c*, 25*c* and is discharged from the outlet liquid traps 31*a*, 31*b* to the regulation passage 30 to cause the above-mentioned ball valve 36 of the non-return valve 18 to be opened. The lubricant flows to the above-mentioned outlet port 23, joins a stream discharged from the above-mentioned second pump 16, and is then supplied to the engine.

At this point, in the non-return valve 18, a control liquid with a normal pressure, when flowing through the vertical passage 37, pushes up the ball valve 36 seated on the valve seat 33 and thus flows from the outlet port 34 to the regulation passage 30, and at this point, the control liquid is discharged from the outlet ports 34*a*, 34*b* in the same amount each and flows through the horizontal passage 38 to the regulation passage 30, so that the ball valve 36 is pushed by the control liquid flowing in the above-mentioned manner, guided by the inner surface of the vertical guide 35 without being biased, and moved upward smoothly without being bound to either of the outlet ports 34*a*, 34*b*.

As described later, when the pressure of the control liquid is reduced, the ball valve 36 is guided by the above-mentioned vertical guide 35 and inner wall of the valve controlling cage 32 and seated on the valve seat 33 to cause the non-return valve to be closed.

Figure 7:
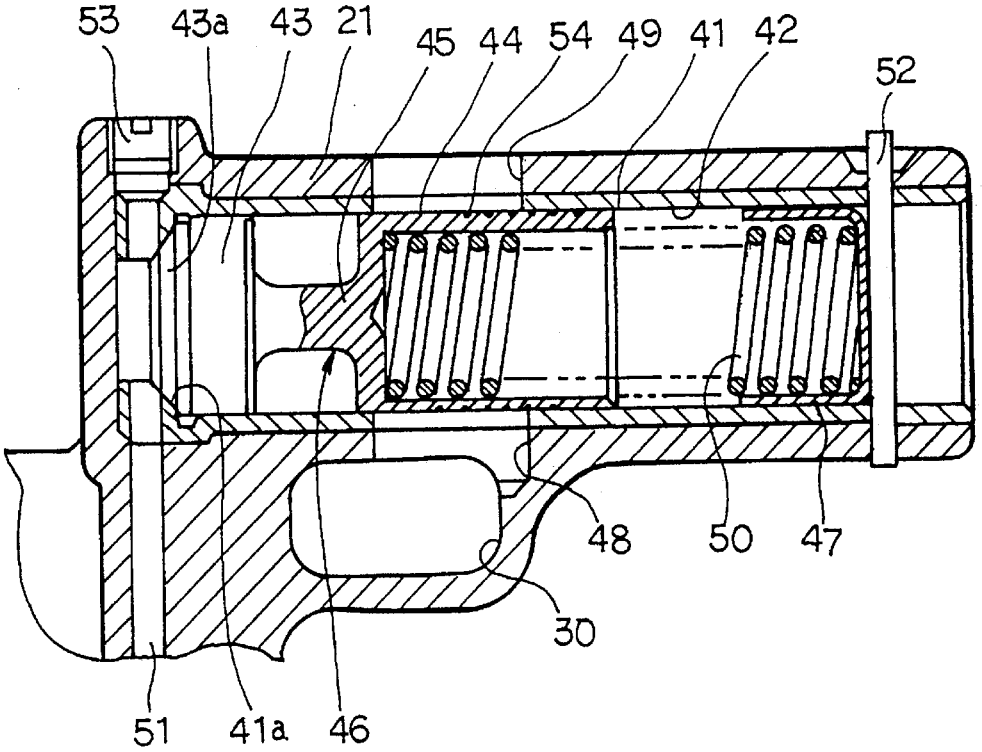
FIG. 7 is a sectional view taken on line E—E of FIG. 1 (during non-operation).

In the above-mentioned relief valve 20, when the pressure in the above-mentioned regulation passage 30 is at a normal pressure or less, as shown in FIG. 7, the above-mentioned piston valve 46 is urged leftward by the valve spring 50. Thus the head 43*a* of the pressure receiving portion 43 of the valve piston 46 is seated on a valve seat 41*a* formed in the above-mentioned sleeve 41, and at this point, although the above-mentioned inlet port 48 and the outlet port 49 are closed by the sliding portion 44 of the piston valve 46, part of the above-mentioned oil grooves 54 faces the inlet port 48 and the outlet port 49, so that the oil on the inlet port 48 side flows to the outlet port 49 while filling the part of the oil grooves 54 facing the inlet port 48 (oil flows in a small amount).

Figure 8:
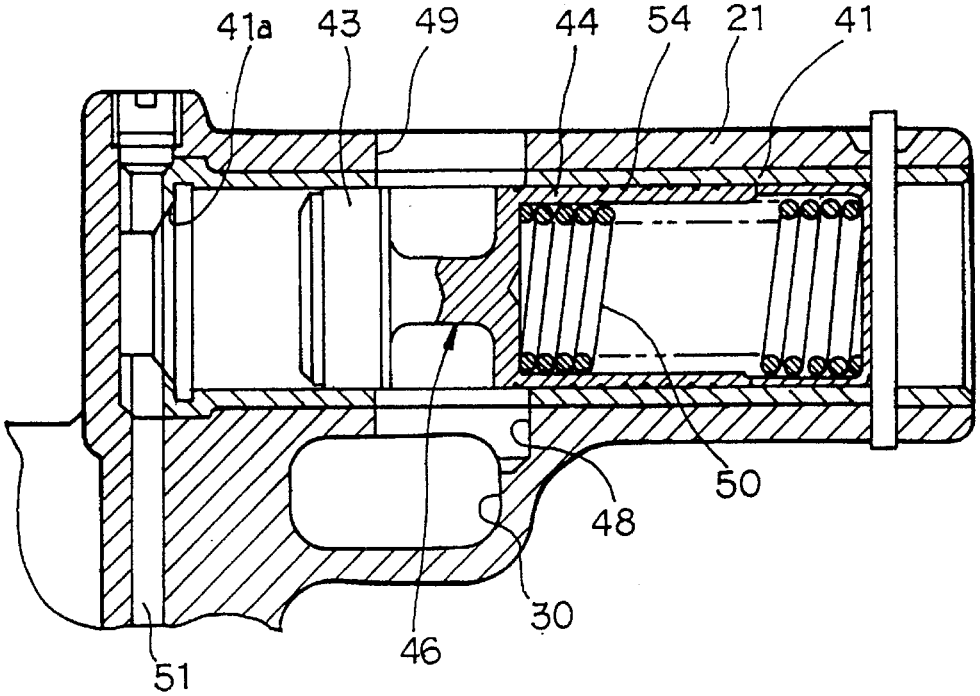
FIG. 8 is a sectional view taken on line E—E of FIG. 1 (during operation).

In this condition, when the relief valve is operated, that is, a hydraulic pressure in the hydraulic passage 51 exceeds a normal set value, as shown in FIG. 8, the piston valve 46 is moved rightward by a hydraulic pressure applied to the head 43*a* of the pressure receiving portion 43 against the valve spring 50. This movement opens the above-mentioned inlet port 48 and outlet port 49, whereby an oil in the upstream of the inlet port 48 is released promptly from the outlet port 49 through a flow regulation passage, not shown, to the oil pan, while when the valve piston 46 is moved, an oil retained in the oil grooves 54 formed on the outer periphery of the sliding portion 44 keeps wet the inner surface of the above-mentioned valve bore 42 to prevent the above-mentioned scuffing.

When the hydraulic pressure in the hydraulic passage 51 is reduced to the normal set value or less, and the valve piston 46 is returned again to the position of FIG. 7, the above-mentioned oil grooves 54, particularly the oil grooves 54 on the opposite side to the above-mentioned connecting rod 45 take in the oil coated on the inner surface of the above-mentioned valve bore 42.

What is claimed is:

1. A gear pump for pumping lubricant from an oil pan, said gear pump comprising:

a pump case formed of a pump body and a cover covering at least part of said pump body;

three gears which are supported by separate rotating shafts mounted to said pump case and that engage each other in series, a central one of said three gears being a central driving gear, and said gears on either side of said central driving gear being driven gears;

first and second pumps, each said pump being composed of said central driving gear and a separate one of said driven gears, each said pump having an inlet side and an outlet side;

an inlet port for receiving the lubricant from the oil pan which is formed at one end of said pump case and connected through a supply passage provided in said cover of said pump case to said inlet side of said first pump an outlet port formed on said outlet side of said second pump in said pump case, and a regulation passage leading from said outlet side of said first pump to said outlet port;

a flow regulation passage leading from said regulation passage through a flow regulation valve that is connected to said regulation passage to the oil pan;

a one-way, non-return valve seated in said regulation passage to allow lubricant to flow from said regulation passage to said outlet port when the pressure of the lubricant in said regulation passage exceeds a predetermined pressure relative to the pressure of the lubricant at said outlet port; and wherein said flow regulation valve is connected between said regulation passage and said flow regulation passage for controlling lubricant flow from said regulation passage to said flow regulation passage.

2. A gear pump according to claim 1, characterized in that said supply passage is formed in a manner to be connected from said inlet port to separate inlet liquid traps associated with said inlet sides of said first and second pumps.

3. A gear pump according to claim 1, characterized in that said regulation passage initially extends vertically upward from said first pump, said non-return valve is positioned in a space in said regulation passage in which said regulation passage changes direction perpendicularly from the vertical to the horizontal direction, and said non-return valve is formed with a valve seat on a lower end portion inside a cylinder and an outlet port on the upper side of said cylinder, and that a valve controlling cage is installed which includes a ball valve which has a diameter smaller than the internal diameter of the cage and is seated on said valve seat to close the passage, and said cage forms a vertical guide at a substantially central part of said outlet port, said guide being disposed toward said outlet port formed in said pump case.

4. A gear pump according to claim 1, characterized in that in said flow regulation valve includes a valve body with a valve bore, a valve piston disposed in said valve bore for opening/closing a valve inlet port and a valve outlet port connected to said flow regulation passage and a valve spring for urging the piston into a valve inlet port-valve outlet port closed position so that an inlet pressure is caused to act on a pressure receiving portion of said valve piston, and a plurality of oil grooves are formed on the outer periphery of a sliding portion of said valve piston that is directed to said valve inlet port when said valve piston is in the valve inlet port-valve outlet port closed position.

* * * * *

UNITED STATES PATENT AND TRADEMARK OFFICE

CERTIFICATE OF CORRECTION

PATENT NO. : 5 609 474

DATED : March 11, 1997

INVENTOR(S) : Tohru OHNO

It is certified that error appears in the above-indentified patent and that said Letters Patent is hereby corrected as shown below:

Column 7, line 20; change "characterized in that" to ---wherein---.

Column 7, line 24; change "characterized in that" to ---wherein---.

Column 8, lines 13 and 14; change "characterized in that in" to ---wherein---.

Column 8, line 18; before "piston" insert ---valve---.

Signed and Sealed this

Twenty-sixth Day of August, 1997

*Attest:*

*Attesting Officer*

BRUCE LEHMAN

*Commissioner of Patents and Trademarks*